US010024542B2

(12) United States Patent
Chang

(10) Patent No.: US 10,024,542 B2
(45) Date of Patent: Jul. 17, 2018

(54) GRILL STOVE

(71) Applicant: Shu-Jui Chang, Taichung (TW)

(72) Inventor: Shu-Jui Chang, Taichung (TW)

( * ) Notice: Subject to any disclaimer, the term of this patent is extended or adjusted under 35 U.S.C. 154(b) by 345 days.

(21) Appl. No.: 14/942,963

(22) Filed: Nov. 16, 2015

(65) Prior Publication Data

US 2017/0138608 A1 May 18, 2017

(51) Int. Cl.
*F23N 1/00* (2006.01)
*F24C 3/12* (2006.01)
*F24C 3/08* (2006.01)

(52) U.S. Cl.
CPC ..... *F24C 3/12* (2013.01); *F23N 1/007* (2013.01); *F24C 3/08* (2013.01); *F23N 2035/12* (2013.01)

(58) Field of Classification Search
CPC ..... F23N 2035/12
USPC ..... 126/39 E
See application file for complete search history.

(56) References Cited

U.S. PATENT DOCUMENTS 9,316,401 B1 * 4/2016 Guste ..... F24C 15/18
2009/0250049 A1 * 10/2009 Tseng ..... A47J 37/0786 126/39 E
2010/0313873 A1 * 12/2010 Zhou ..... F23Q 3/002 126/39 BA

* cited by examiner

*Primary Examiner* — Avinash Savani

(57) ABSTRACT

A grill stove contains a grilling body and plural heating devices. Each grilling device includes a first heat tube, a second heat tube, an accommodation seat, and a valve unit. The accommodation seat has a first conduit, a second conduit, a gas supply tube, and a dispersion tube. The valve unit has a driving shaft and a control valve, the driving shaft extends out of the accommodation seat and is in connection with a first end of the control valve, and a second end of the valve unit inserts into the first conduit. The control valve has a channel, a first through orifice, a second through orifice, and a third through orifice. The control valve is rotated to stop the gas supply tube, to communicate with the gas supply tube via the first through orifice or to communicate with the gas supply tube via the second through orifice.

2 Claims, 8 Drawing Sheets

GRILL STOVE

FIELD OF THE INVENTION

The present invention relates to a grill stove which controls a first heat tube and a second heat tube in three modes to grill different amounts of ingredients.

BACKGROUND OF THE INVENTION

A conventional grill stove contains a plurality of gas tubes arranged therein, and each gas tube is controlled by a control knob. However, said each gas tube cannot supply fixed amount gases stably, thus burning ingredients unevenly.

The present invention has arisen to mitigate and/or obviate the afore-described disadvantages.

SUMMARY OF THE INVENTION

The primary objective of the present invention is to provide a grill stove which controls a first heat tube and a second heat tube in three modes to grill different amounts of ingredients.

To obtain the above objective, a grill stove provided by the present invention contains: a grilling body and a plurality of heating devices.

The plurality of heating devices are arranged in the grilling body, each grilling device includes a first heat tube and a second heat tube parallelly connected with the first heat tube, and said each grilling device also includes an accommodation seat and a valve unit.

The accommodation seat has a first conduit communicating with the first heat tube, a second conduit communicating with the second heat tube, a gas supply tube communicating with the first conduit, and a dispersion tube communicating with the first conduit and the second conduit.

The valve unit has a driving shaft and a control valve which are housed in the accommodation seat, wherein a first end of the driving shaft extends out of the accommodation seat, a second end of the driving shaft is in connection with a first end of the control valve, and a second end of the valve unit inserts into the first conduit.

The control valve has a channel communicating with the first conduit, the control valve also has a first through orifice, a second through orifice and a third through orifice which are defined on the control valve and communicate with the channel. The control valve is rotated to stop the gas supply tube, to communicate with the gas supply tube via the first through orifice or to communicate with the gas supply tube via the second through orifice.

The control valve is rotated to stop the dispersion tube or to communicate with the dispersion tube via the third through orifice, wherein when the first conduit is in communication with the gas supply tube, the control valve stops the dispersion tube, and when the second through orifice is in communication with the gas supply tube, the third through orifice communicates with the dispersion tube.

The control valve further has a fourth through orifice and a fifth through orifice which are in communication with the channel, wherein a diameter of each of the fourth through orifice and the fifth through orifice is less than that of each of the first through orifice, the second through orifice, and the third through orifice, when the control valve is rotated to communicate the fourth through orifice with the gas supply tube, the fifth through orifice is in communication with the dispersion tube.

The valve unit further has a first stop piece, a second stop piece, and a spring which are housed in the accommodation seat, wherein the first stop piece is fitted and rotates with the driving shaft, the second stop piece is fitted with the control valve, the spring is fitted between the driving shaft and the control valve, and two ends of the spring abut against the first stop piece and the second stop piece; the first stop piece has a plurality of tilted guiding faces formed thereon opposite to the spring, the accommodation seat has plural oblique push faces corresponding to the first stop piece and abutting against the plurality

DETAILED DESCRIPTION OF THE PREFERRED EMBODIMENTS

Figure 1:
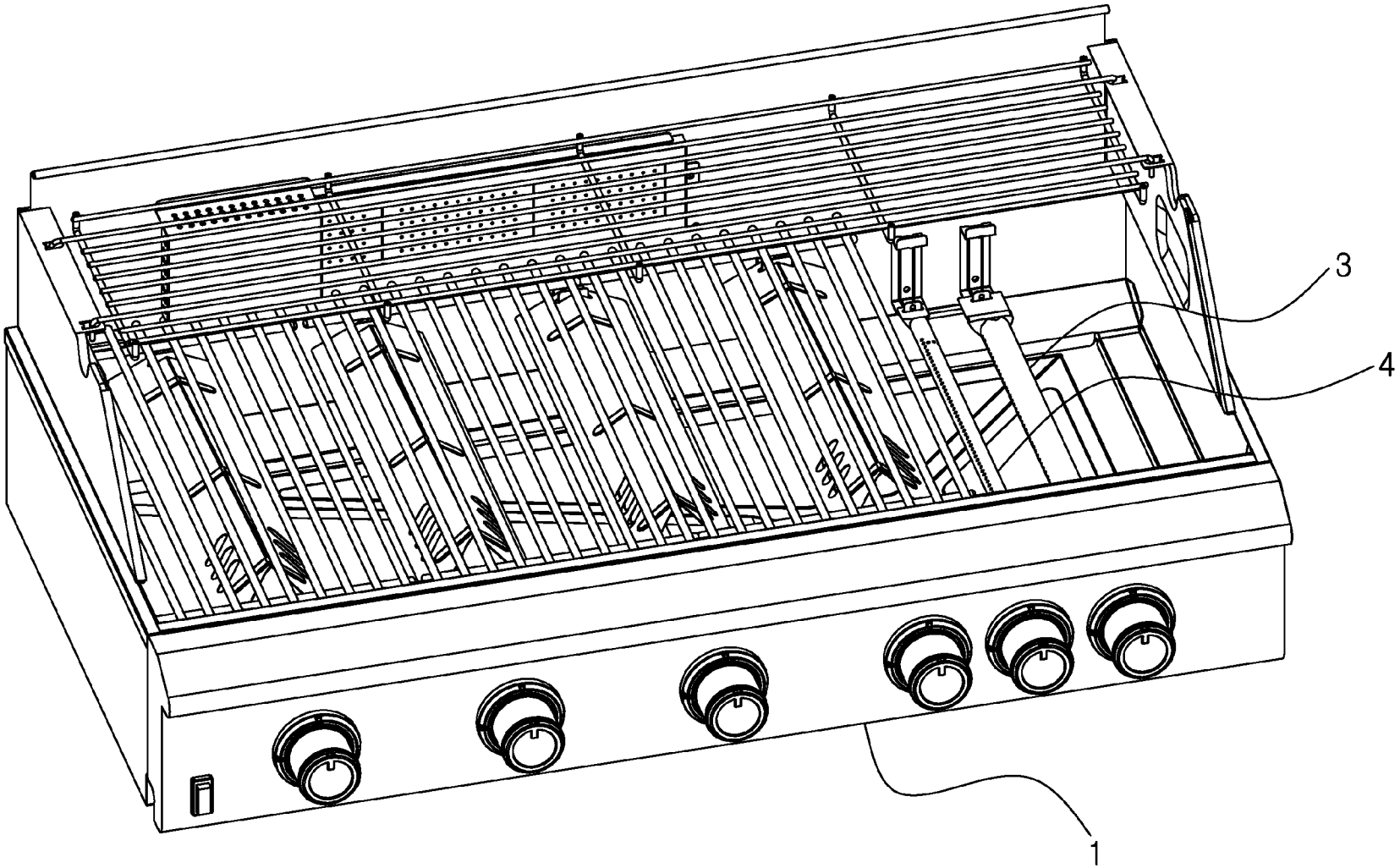
FIG. 1 is a perspective view showing the assembly of a grill stove according to a preferred embodiment of the present invention.
Figure 2:
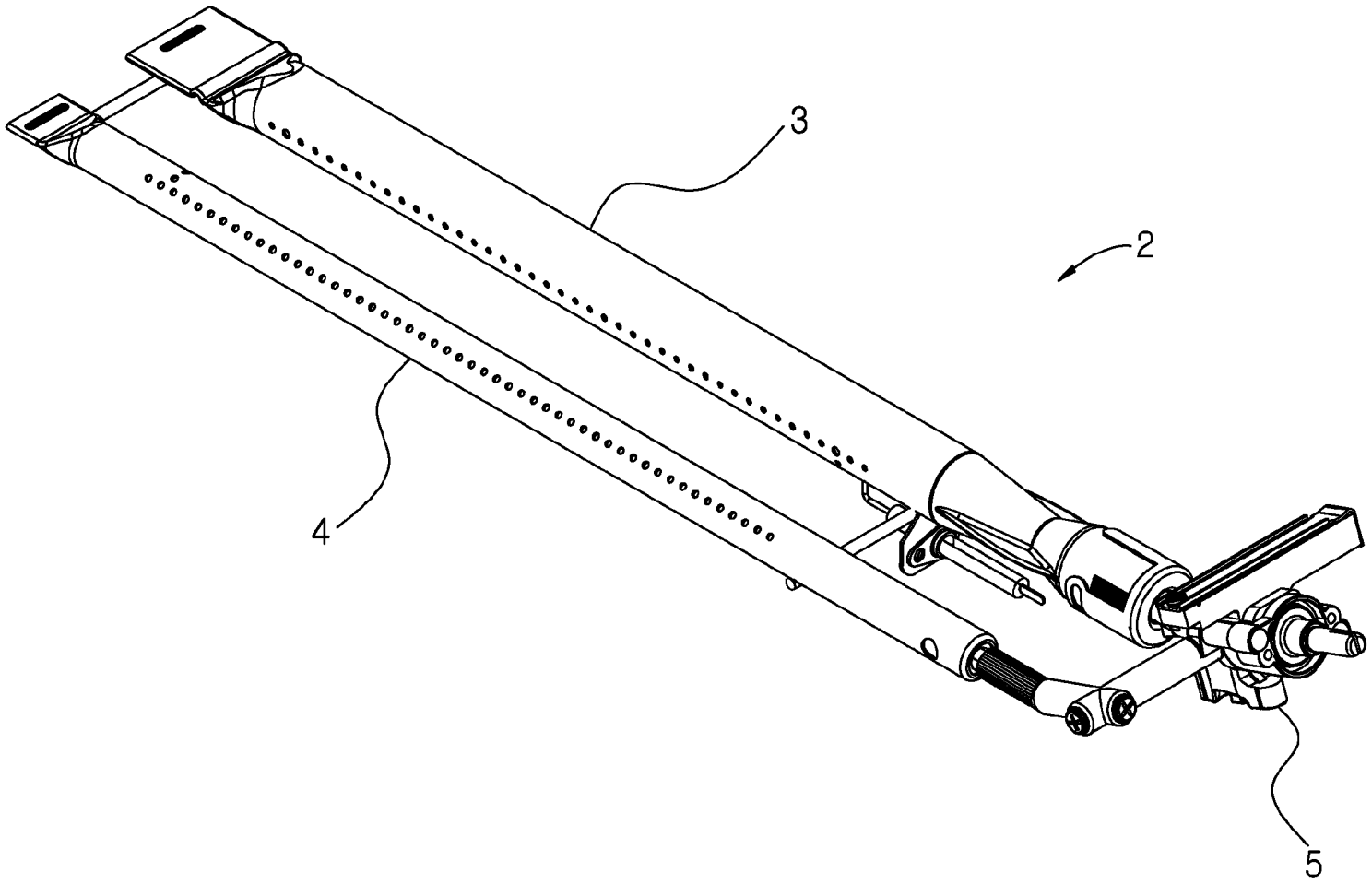
FIG. 2 is a perspective view showing the assembly of a part of the grill stove according to the preferred embodiment of the present invention.
Figure 3:
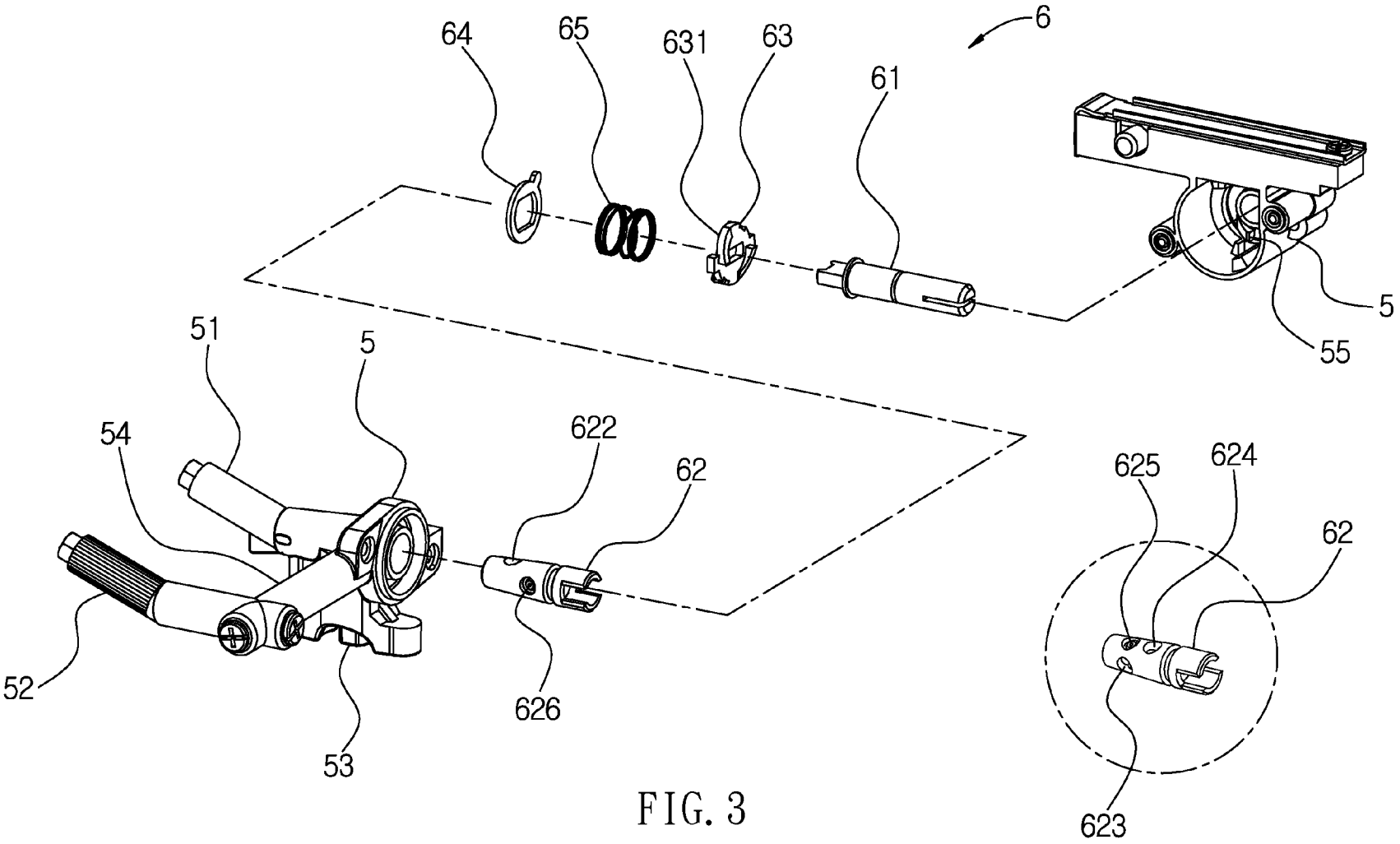
FIG. 3 is a perspective view showing the exploded components of a part of the grill stove according to the preferred embodiment of the present invention.
Figure 4:
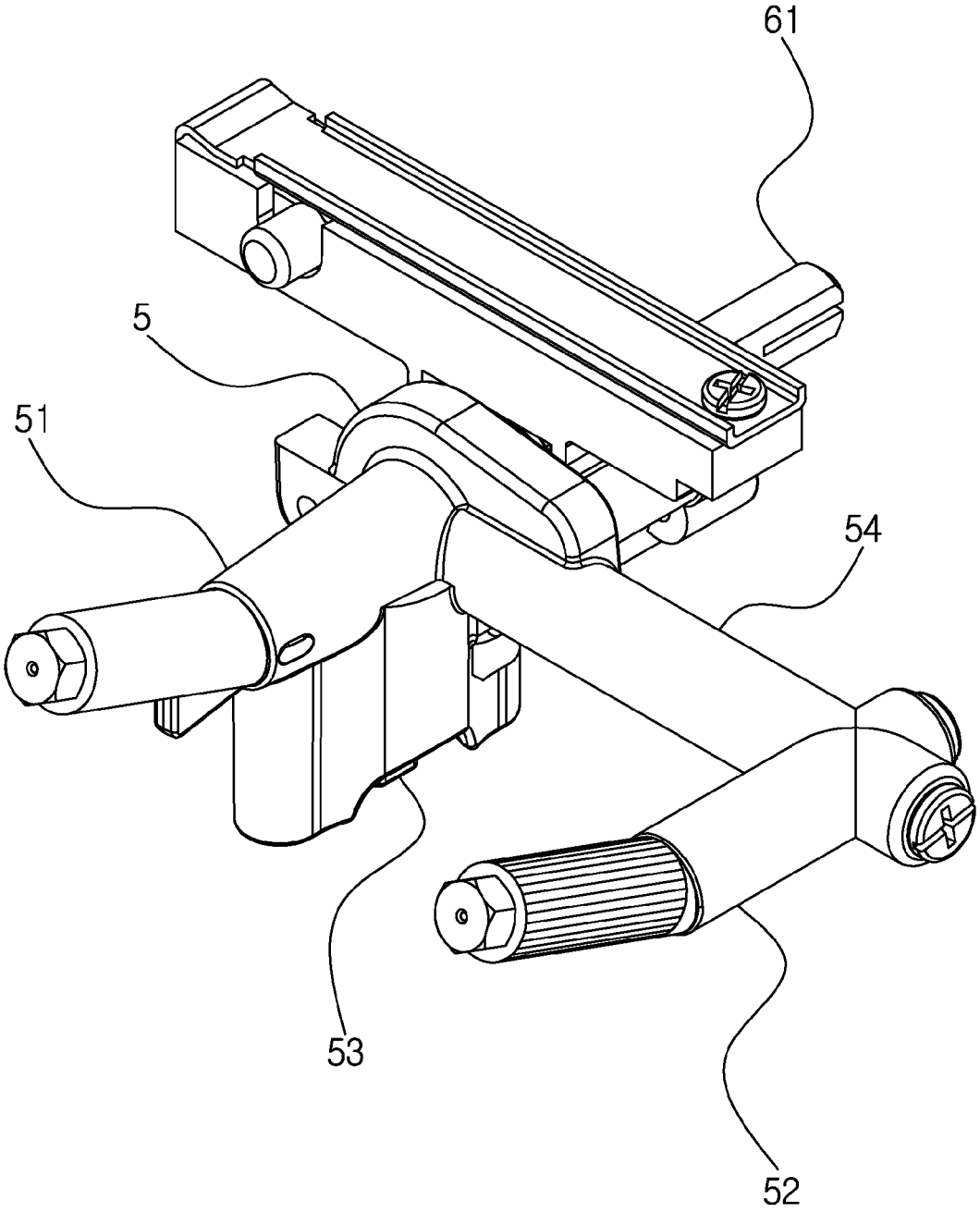
FIG. 4 is another perspective view showing the assembly of a part of the grill stove according to the preferred embodiment of the present invention.

With reference to FIGS. 1 to 4, a grill stove according to a preferred embodiment of the present invention comprises: a grilling body 1 and a plurality of heating devices 2.

The plurality of heating devices 2 are arranged in the grilling body 1, each grilling device 2 includes a first heat tube 3 and a second heat tube 4 parallelly connected with the first heat tube 3, and said each grilling device 2 also includes an accommodation seat 5 and a valve unit 6.

The accommodation seat 5 has a first conduit 51 communicating with the first heat tube 3, a second conduit 52 communicating with the second heat tube 4, a gas supply tube 53 communicating with the first conduit 51, and a dispersion tube 54 communicating with the first conduit 51 and the second conduit 52. The valve unit 6 has a driving shaft 61 and a control valve 62 which are housed in the accommodation seat 5, wherein a first end of the driving shaft 61 extends out of the accommodation seat 5, a second end of the driving shaft 61 is in connection with a first end of the control valve 62, and a second end of the valve unit 6 inserts into the first conduit 51. The control valve 62 has a channel 621 communicating with the first conduit 51. The control valve 62 also has a first through orifice 622, a second through orifice 623, and a third through orifice 624 which are defined on the control valve 62 and communicate with the channel 621. The control valve 62 is rotated to stop the gas supply tube 53, to communicate with the gas supply tube 53 via the first through orifice 622 or to communicate with the gas supply tube 53 via the second through orifice 623. In addition, the control valve 62 is rotated to stop the dispersion tube 54 or to communicate with the dispersion tube 54 via the third through orifice 624, wherein when the first conduit 622 is in communication with the gas supply tube 53, the control valve 62 stops the dispersion tube 54, and when the second through orifice 623 is in communication with the gas supply tube 53, the third through orifice 624 communicates with the dispersion tube 54. The control valve 62 further has a fourth through orifice 625 and a fifth through orifice 626 which are in communication with the channel 621, wherein a diameter of each of the fourth through orifice 625 and the fifth through orifice 626 is less than that of each of the first through orifice 622, the second through orifice 623, and the third through orifice 624, when the control valve 62 is rotated to communicate the fourth through orifice 626 with the gas supply tube 53, the fifth through orifice 626 is in communication with the dispersion tube 54.

Referring to FIGS. 5 to 12, in operation, gases flow into the gas supply tube 53, the valve unit 6 controls the first heat tube 3 and/or the second heat tube 4 to operate so as to control burning of the grill stove, wherein the driving shaft 61 partially connects with an on/off knob, and the driving shaft 61 drives the control valve 62 to control the first heat tube 3 and the second heat tube 4 in three modes.

Figure 5:
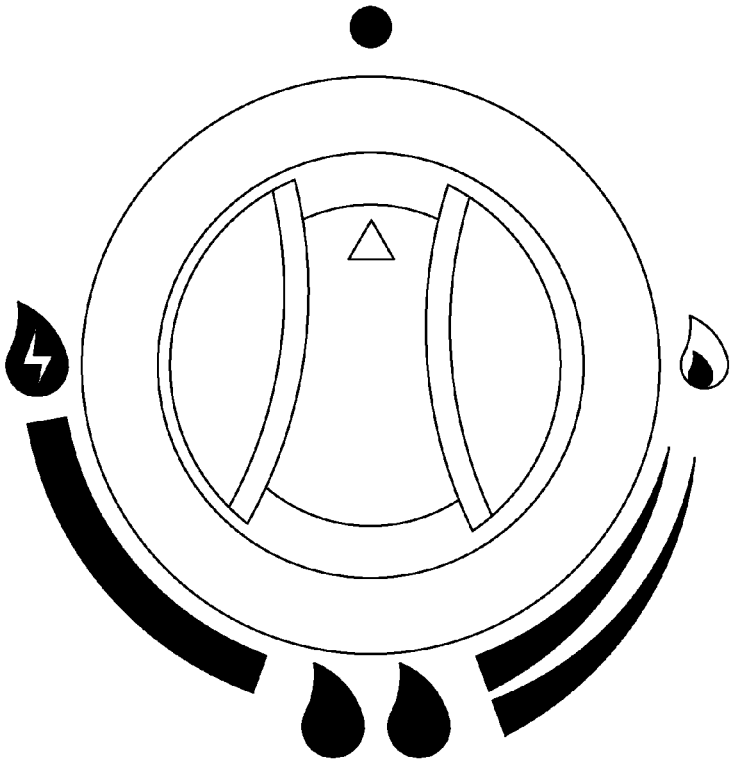
FIG. 5 is a plane side view showing the operation of the grill stove according to the preferred embodiment of the present invention.
Figure 6:
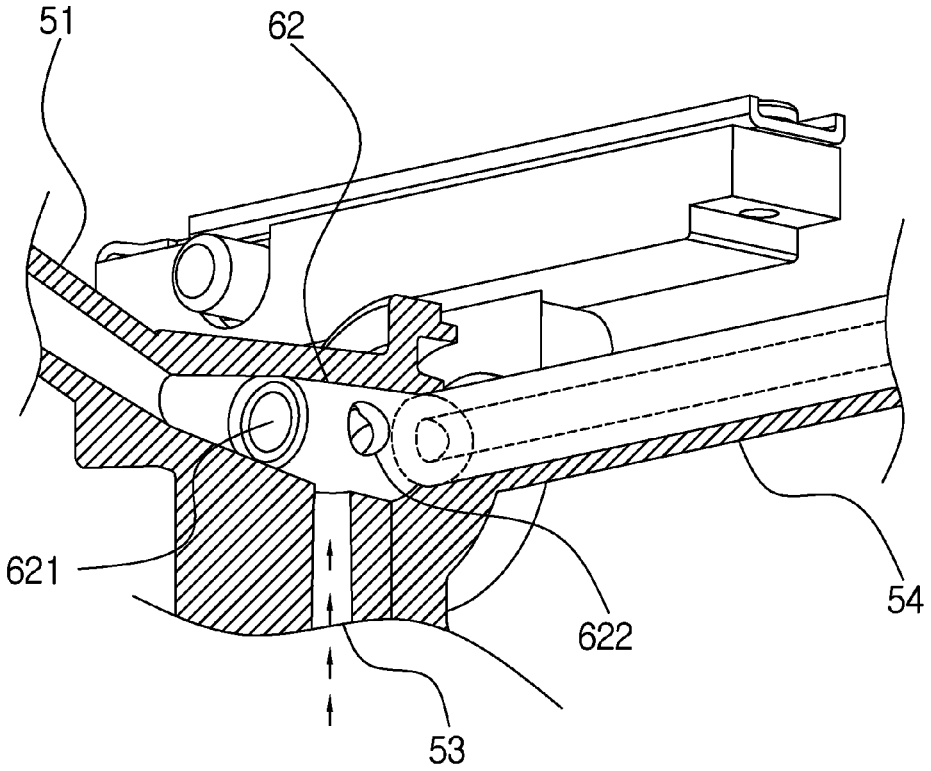
FIG. 6 is a cross sectional side view showing the operation of the grill stove according to the preferred embodiment of the present invention.

In a first mode, when the control valve 62 stops the gas supply tube 53, the gases do not flow into the channel 621, and the first heat tube 3 and the second heat tube 4 are in a closing state (as shown in FIGS. 5 and 6).

Figure 7:
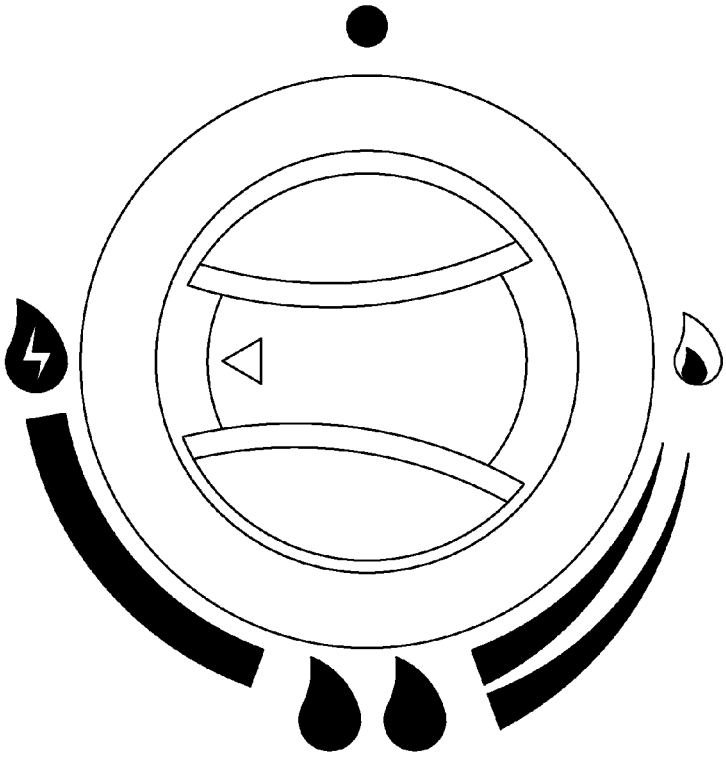
FIG. 7 is another plane side view showing the operation of the grill stove according to the preferred embodiment of the present invention.
Figure 8:
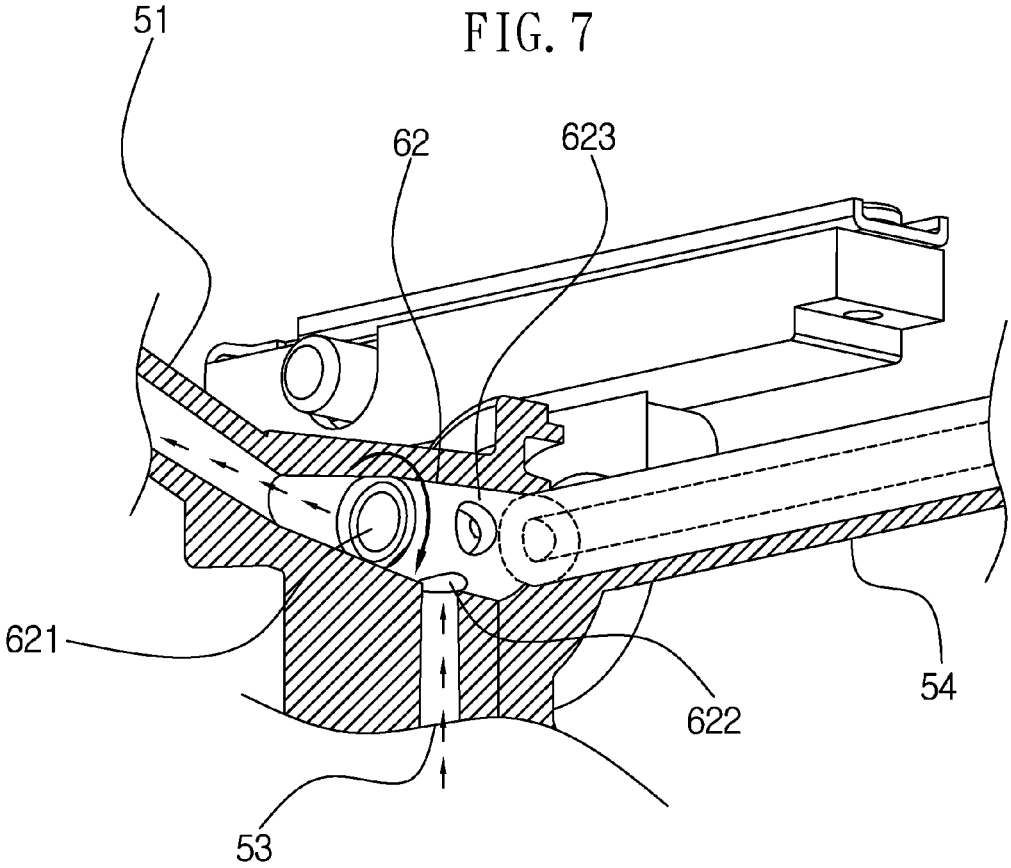
FIG. 8 is another cross sectional side view showing the operation of the grill stove according to the preferred embodiment of the present invention.

In a second mode, when the control valve 62 is rotated to communicate the first through orifice 622 with the gas supply tube 53, the gases flow into the first conduit 51 via the channel 621 so that the first heat tube 3 is in an opening state, and the dispersion tube 54 is stopped by the control valve 62, so the second heat tube 4 is in the closing state. Accordingly, the first heat tube 3 of the grill stove generates heat source to grill small amount of ingredients (as illustrated in FIGS. 7 and 8).

Figure 9:
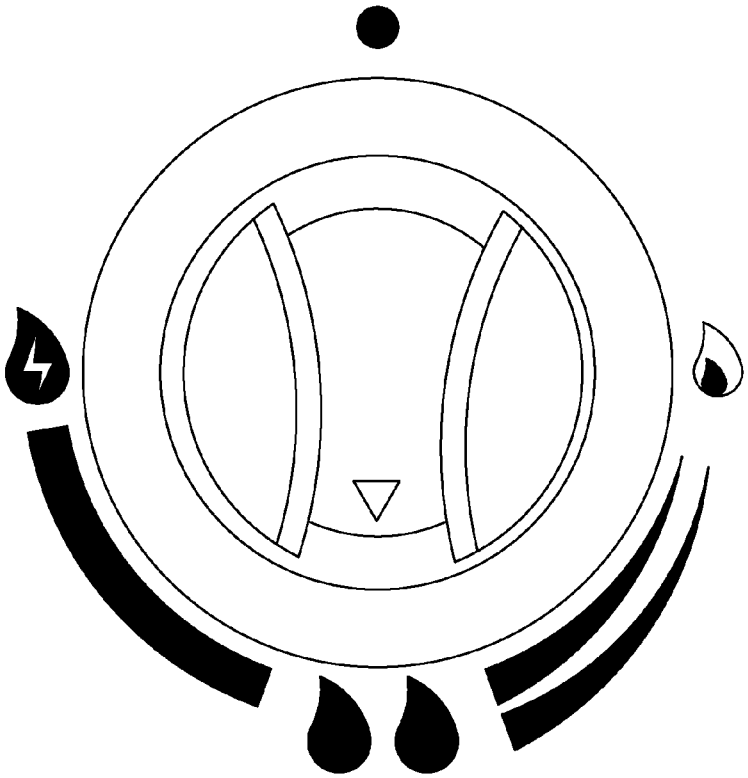
FIG. 9 is also another plane side view showing the operation of the grill stove according to the preferred embodiment of the present invention.
Figure 10:
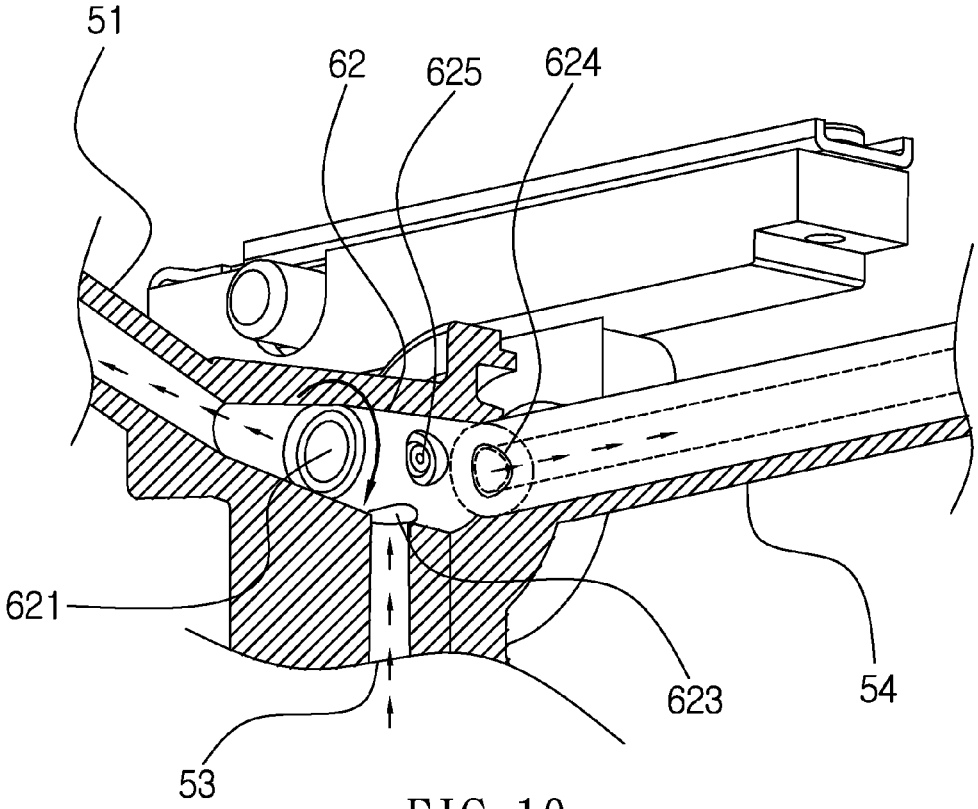
FIG. 10 is also another cross sectional side view showing the operation of the grill stove according to the preferred embodiment of the present invention.

In a third mode, when the control valve 62 is rotated to communicate the second through orifice 623 with the gas supply tube 53 and to communicate the third through orifice 624 with the dispersion tube 54, the gases flow into the first conduit 51 and the dispersion tube 54 via the channel 621 so that the first heat tube 3 and the second heat tube 4 are in the opening state. Accordingly, the first heat tube 3 and the second heat tube 4 of the grill stove generate the heat source to grill large amount of ingredients (as shown in FIGS. 9 and 10).

Figure 11:
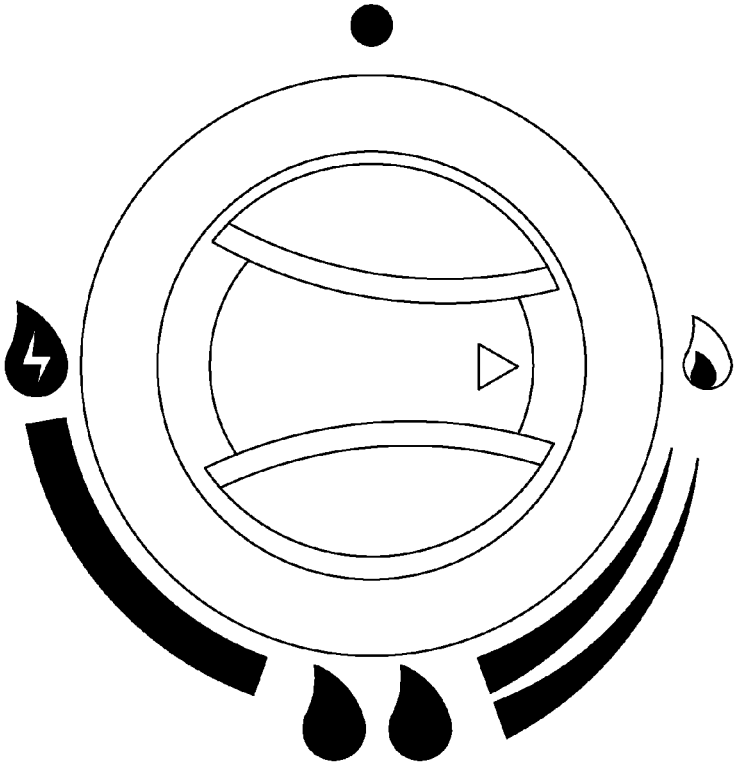
FIG. 11 is still another plane side view showing the operation of the grill stove according to the preferred embodiment of the present invention.
Figure 12:
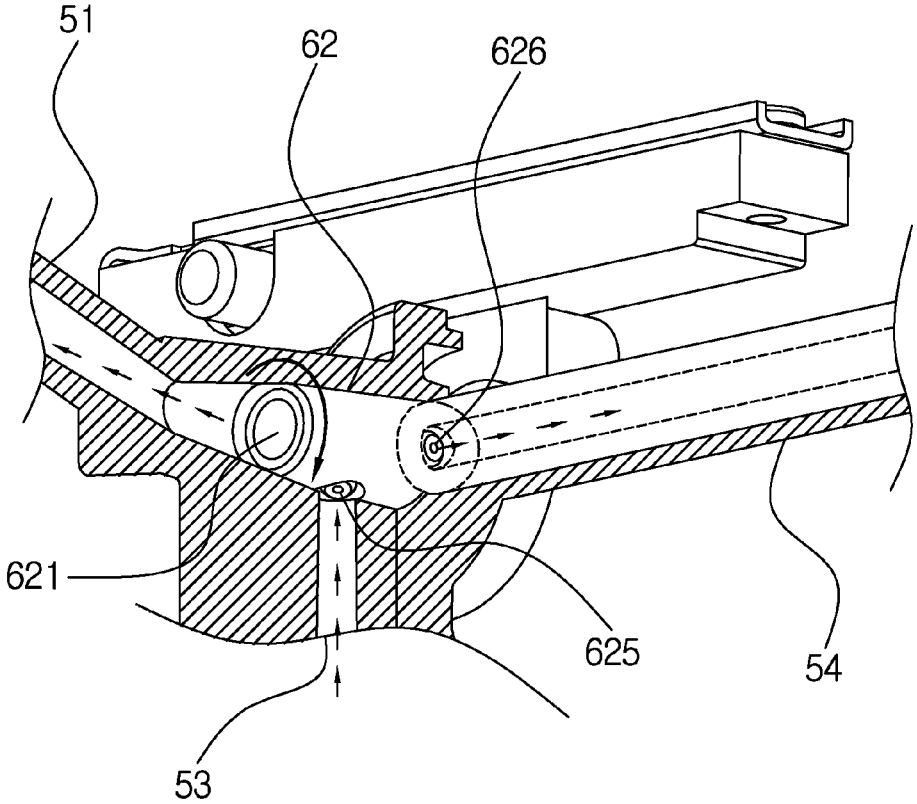
FIG. 12 is still another cross sectional side view showing the operation of the grill stove according to the preferred embodiment of the present invention.

When the control valve 62 is rotated to communicate the fourth through orifice 625 with the gas supply tube 53 and to communicate the fifth through orifice 626 with the dispersion tube 54, the gases flow into the first conduit 51 and the dispersion tube 54 via the channel 621 so that the first heat tube 3 and the second heat tube 4 are in the opening state. Since the diameter of each of the fourth through orifice 625 and the fifth through orifice 626 is less than that of each of the first through orifice 622, the second through orifice 623, and the third through orifice 624, the gases flow into the first heat tube 3 and the second heat tube 4 decreasingly, so the first heat tube 3 and the second heat tube 4 of the grill stove generate less heat source to grill large amount of ingredients (as shown in FIGS. 11 and 12).

The valve unit 6 further has a first stop piece 63, a second stop piece 64, and a spring 65 which are housed in the accommodation seat 5, wherein the first stop piece 63 is fitted and rotates with the driving shaft 61, the second stop piece 62 is fitted with the control valve 62, the spring 65 is fitted between the driving shaft 61 and the control valve 62, and two ends of the spring 65 abut against the first stop piece 63 and the second stop piece 64. The first stop piece 61 has a plurality of tilted guiding faces 631 formed thereon opposite to the spring 65, the accommodation seat 5 has plural oblique push faces 55 corresponding to the first stop piece 63 and abutting against the plurality of tilted guiding faces 631, such that the first stop piece 63 is driven by the driving shaft 61 to revolve, the first stop piece 63 is pushed by the plural oblique push faces 55 to press the spring 65 and then is pushed back to an original position by the spring 65, and the driving shaft 61 rotates reversely and fixes.

The grill stove controls the first heat tube 3 and the second heat tube 4 in the three modes to grill different amounts of ingredients.

While the preferred embodiments of the invention have been set fourth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A grill stove comprising:

a grilling body, and a plurality of heating devices, the plurality of heating devices being arranged in the grilling body, each grilling device including a first heat tube and a second heat tube parallelly connected with the first heat tube, each grilling device also including an accommodation seat and a valve unit, wherein:

the accommodation seat has a first conduit communicating with the first heat tube, a second conduit communicating with the second heat tube, a gas supply tube communicating with the first conduit, and a dispersion tube communicating with the first conduit and the second conduit;

the valve unit has a driving shaft and a control valve which are housed in the accommodation seat, wherein a first end of the driving shaft extends out of the accommodation seat, a second end of the driving shaft connects with a first end of the control valve, and a second end of the valve unit is inserted into the first conduit;

the control valve has a channel communicating with the first conduit, the control valve also having a first through orifice, a second through orifice, and a third through orifice which are defined on the control valve and in communication with the channel, the control valve being rotatable to stop the gas supply tube, to communicate with the gas supply tube via the first through orifice, or to communicate with the gas supply tube via the second through orifice;

the control valve is rotatable to stop the dispersion tube or to communicate with the dispersion tube via the third through orifice, wherein when the first conduit is in communication with the gas supply tube, the control valve stops the dispersion tube, and when the second through orifice is in communication with the gas supply tube, the third through orifice communicates with the dispersion tube; and the control valve further comprises a fourth through orifice and a fifth through orifice which are in communication with the channel, wherein a diameter of each of the fourth through orifice and the fifth through orifice is less than that of each of the first through orifice, the second through orifice, and the third through orifice, and when the control valve is rotated to communicate the fourth through orifice with the gas supply tube, the fifth through orifice is in communication with the dispersion tube.

2. A grill stove comprising:

a grilling body, and a plurality of heating devices, the plurality of heating devices being arranged in the grilling body, each grilling device including a first heat tube and a second heat tube parallelly connected with the first heat tube, each grilling device also including an accommodation seat and a valve unit, wherein:

the accommodation seat has a first conduit communicating with the first heat tube, a second conduit communicating with the second heat tube, a gas supply tube communicating with the first conduit, and a dispersion tube communicating with the first conduit and the second conduit;

the valve unit has a driving shaft and a control valve which are housed in the accommodation seat, wherein a first end of the driving shaft extends out of the accommodation seat, a second end of the driving shaft connects with a first end of the control valve, and a second end of the valve unit is inserted into the first conduit;

the control valve has a channel communicating with the first conduit, the control valve also having a first through orifice, a second through orifice, and a third through orifice which are defined on the control valve and in communication with the channel, the control valve being rotatable to stop the gas supply tube, to communicate with the gas supply tube via the first through orifice, or to communicate with the gas supply tube via the second through orifice;

the control valve is rotatable to stop the dispersion tube or to communicate with the dispersion tube via the third through orifice, wherein when the first conduit is in communication with the gas supply tube, the control valve stops the dispersion tube, and when the second through orifice is in communication with the gas supply tube, the third through orifice communicates with the dispersion tube; and the valve unit further comprises a first stop piece, a second stop piece, and a spring which are housed in the accommodation seat, wherein the first stop piece is fitted and rotates with the driving shaft, the second stop piece is fitted with the control valve, the spring is fitted between the driving shaft and the control valve, and two ends of the spring abut against the first stop piece and the second stop piece; the first stop piece has a plurality of tilted guiding faces formed thereon opposite to the spring, the accommodation seat has plural oblique push faces corresponding to the first stop piece and abutting against the plurality of tilted guiding faces.

* * * * *